United States Patent [19]

Wanderer

[11] 4,287,996

[45] Sep. 8, 1981

[54] FLEXIBLE CLOSURES AND CLOSURE FOR BUNG OPENINGS

[75] Inventor: Herbert J. Wanderer, Wheatridge, Colo.

[73] Assignee: Denver Plastics, Inc., Denver, Colo.

[21] Appl. No.: 83,110

[22] Filed: Oct. 9, 1979

[51] Int. Cl.[3] ..... B65D 39/00

[52] U.S. Cl. ..... 217/108; 220/233; 220/307; 220/DIG. 19; 217/110

[58] Field of Search ..... 220/233, 200, 98, 302, 220/305, DIG. 19; 217/78, 104, 108, 110; 215/358, 362, 363, 365; 138/89

[56] References Cited

U.S. PATENT DOCUMENTS

| | | | |
|---|---|---|---|
| 2,167,597 | 7/1939 | Webb | 220/213 X |
| 2,487,635 | 11/1949 | Carpenter | 220/233 X |
| 3,244,316 | 4/1966 | Atkinson et al. | 220/318 X |
| 3,438,531 | 4/1969 | Millard et al. | 217/110 |
| 3,473,686 | 10/1969 | Kusserow | 217/108 |
| 3,982,649 | 9/1976 | Wanderer | 217/108 |

*Primary Examiner*—George T. Hall
*Attorney, Agent, or Firm*—Ancel W. Lewis, Jr.

[57] ABSTRACT

The problem of providing tight-fitting closures for containers is solved by the closures and the methods of installing and removing closures utilizing a closure (20) which includes a central portion (21) and an annulus portion (22) hingedly connected to the central portion by a hinge (23) to enable at least a portion of the annulus portion to contract during insertion and removal operations. The annulus portion pivots to an expanded position to become compressed between the central portion and the orifice surface (25). A retaining portion (68) in a modified form of closure serves to hold the outer edge of the annulus portion relative to movement of the central portion and to prevent premature removal. In installing and removing, the closure is readily adapted to be turned at an angle to the axis of the orifice for easier insertion and removal and for bung-type closures the filler apparatus for a beer barrel is useful in installing these closures.

19 Claims, 21 Drawing Figures

FLEXIBLE CLOSURES AND CLOSURE FOR BUNG OPENINGS

TECHNICAL FIELD

The present invention relates generally to closures for containers and more particularly to novel and improved closures for containers, pressurized barrels and the like and methods for installing and removing the closures from an orifice.

BACKGROUND ART

There are numerous applications which require a closure for an orifice that will contract so as to be readily installed, will expand in the final position to remain firmly in place in a tight-fitting relationship, and will contract so as to be readily removed.

In the brewing industry, for example, beer is often packaged and transported in pressurized metal barrels. A fill orifice is typically provided on each barrel through which the barrel is filled with beer. The filler apparatus for filling the barrels generally includes a movable rack arm or the like which is clamped to the barrel in sealing engagement with the fill orifice, and a fill tube which is inserted through the orifice to direct pressurized gases and beer into the barrel. When a barrel has been filled the rack arm and fill tube are removed from the barrel and a wooden or plastic closure, commonly referred to as a bung, is sealingly affixed to the fill orifice.

In the past it has been common practice for a filler operator to remove the rack arm and fill tube from the barrel and drive the bung into sealing engagement with the fill orifice, utilizing an impact tool such as a hand-held mallet. A problem with this method of installing a bung is that, once the rack arm and fill tube are removed from the barrel and before the bung is driven into the barrel, the pressurized gases within the filled barrel are free to vent through the fill orifice to the atmosphere. The filler operator must therefore act quickly to drive the bung into the orifice before all of the pressurized gases are vented.

In addition, with this method of installing bungs, considerable force is required to drive the bung into the orifice and the bung or fill orifice may be damaged by the impact. Alternatively, if too little force is utilized, the bung may not be properly driven into the orifice, resulting in an ineffective seal.

Moreover, with the prior art impact method of installation, the bung must be strong enough to absorb a considerable impact force without damage. If the bung is constructed with plastic material, a relatively large amount of material must be utilized to insure adequate strength during installation and rigidity for the bung.

In addition to these problems with the installation of prior art bungs, there are also difficulties involved in removing the bungs from the barrels after the contents have been removed. The bungs, for instance, are generally shaped to be driven into the orifice from the outside in. Because of this shape the bungs are sometimes difficult to pull out of the orifice without being pushed into the barrel or without scratching the walls of the orifice with the removing device.

Accordingly, it is a general object of the present invention to provide a novel and improved orifice closure that is readily installed and removed and is not easily dislodged from the orifice during use.

Another object of the present invention is to provide a novel flexible closure for an orifice characterized by the capability of a substantial contraction during insertion and removal and capable of a substantial expansion into a tight fit in the final position in the orifice.

Still another object of the present invention is to provide a novel closure that requires less material than previously required, is lighter and less bulky, and is highly effective in closing and sealing the continer orifice into which it is inserted.

A further object of the present invention is to provide a novel and improved closure particularly suited for a pressurized barrel that can be installed without an impact tool by inserting the closure through an orifice in the barrel at an angle to the orifice and by pulling the closure back into sealing engagement with the orifice.

Yet another object of the present invention is to provide a novel and improved bung for a pressurized barrel that can be easily removed from the barrel by gripping the bung, pushing it free of the orifice, tilting the bung at an angle to the orifice, and pulling the bung out of the orifice.

Still a further object of the present invention is to provide an improved bung for a pressurized barrel made of resilient thermoplastic material with at least a portion of a sealing surface carried by a hinged annulus portion constructed to yield toward the center of the bung upon insertion into an orifice in the barrel and to expand from the pressure within the barrel acting on the hinged annulus portion for engagement with the orifice wall surface for sealing the barrel and maintaining the bung in position in the orifice.

DISCLOSURE OF INVENTION

A flexible closure has an annulus portion connected by a hinge to a central portion and pivotable about said hinge so that at least a circumferential part of the annulus portion will contract toward or expand away from the central portion during insertion and removal operations. In the expanded position the annulus portion pivots to an angular disposition so that it expands substantially normal to the longitudinal axis of the central portion and is compressed between the central portion and the orifice wall surface with a peripheral surface thereof being urged against a surface defining the orifice. The closure is preferably made as a unitary body of a resiliently yieldable material such as polyolefins. In a bung-type closure a retaining portion is connected to the annulus portion for holding an outside edge of the annulus portion relative to movement of the central portion toward the top of the orifice as well as to prevent the closure from being prematurely removed from the orifice such as due to excessive container pressures. The annulus portion is responsive to container pressures to also urge the peripheral surface against the orifice surface. During installation of the closure with the retaining portion the closure is turned at an angle to the axis of the orifice for insertion and removal, and during removal the closure is first pushed through and beyond the orifice, turned at an angle, and then pulled back through the orifice.

Other objects, advantages and capabilities of the present invention will become more apparent as the description proceeds, taken in conjunction with the accompanying drawings in which like parts have like reference numerals and in which:

DETAILED DESCRIPTION

Figure 1:
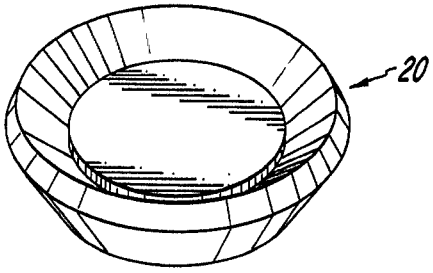
FIG. 1 is a top perspective view of a closure embodying features of the present invention.
Figure 2:
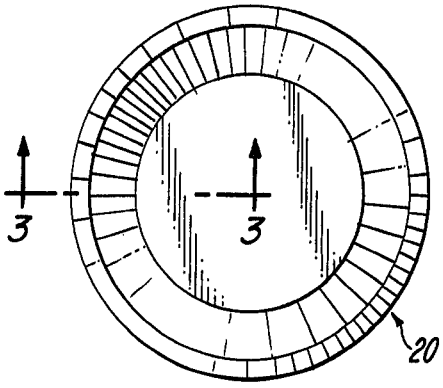
FIG. 2 is a top plan view of the closure shown in FIG. 1.
Figure 3:
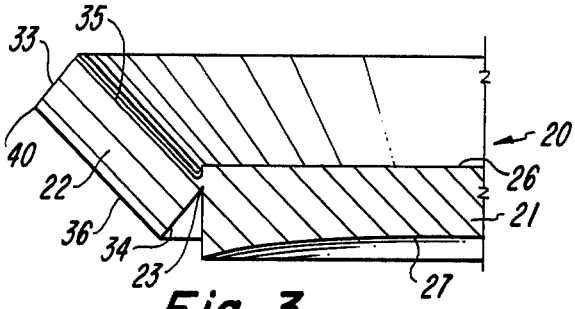
FIG. 3 is a cross-sectional view taken along line 3—3 of FIG. 2 showing the closure in the at-rest position.

Referring now to FIGS. 1–7, the flexible closure 20 shown generally comprises a central portion 21 and an annulus portion 22 arranged about the central portion 21 and connected at an inside edge by a hinge 23 to the periphery of the central portion. The hinge 23 is between the top and bottom of the central portion but closer to the top. The flexible closure 20 shown is specifically adapted to close a circular orifice 24 defined by a circular wall surface 25 having a uniform dimension throughout the wall thickness. The central portion 21 shown is generally cylindrical with a flat top wall surface 26 and an upwardly arched bottom wall surface 27. The central portion 21 shown then is generally disc-like. The top wall 26 is suitable for being engaged by a gripping tool such as a vacuum cup 28 as a means for gripping the closure 20 for installation and removal purposes.

Figure 4:
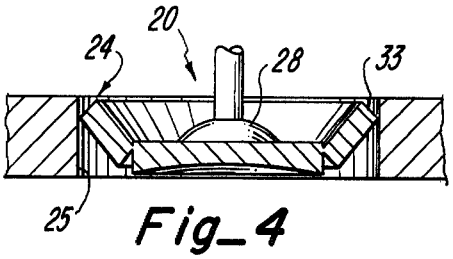
FIG. 4 is a cross-sectional view of the closure shown in FIG. 1 being inserted into an orifice, showing the annulus portion of the closure in a contracted position.
Figure 7:
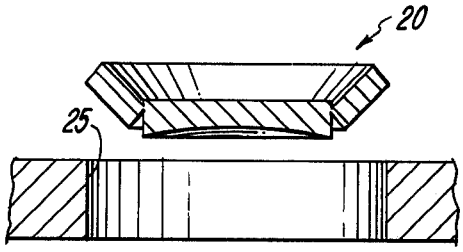
FIG. 7 is a cross-sectional view of the closure in the fully removed position.
Figure 5:
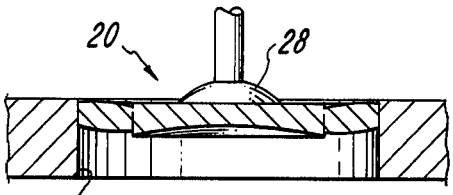
FIG. 5 is a cross-sectional view of the closure in the installed expanded position in the orifice.

The annulus portion 22 is of generally frusto-conical shape arranged to taper or diverge away from the bottom of the central portion 21 and has a generally rectangular cross section with an inclined peripheral surface 33 and an inclined inside surface 34 opposite and extending substantially parallel to peripheral surface 33 along with a cone-shaped top surface 35 and a cone-shaped bottom surface 36. The bottom surface 36 and the peripheral surface 33 meet at a corner 40 that serves to press against the wall surface 25 defining the orifice when the closure is first inserted in the orifice (FIG. 4) and then bite or wedge against and offers resistance to removal when a reverse pull is exerted on the central portion 26 causing the annulus portion to move to the expanded position (FIG. 5).

The internal diameter of the orifice 24 preferably is sized smaller than the external diameter of the closure 20 in the at-rest position so that it will be necessary for at least a portion of the annulus portion to contract during insertion into the orifice. This contraction comes about primarily as a result of the annulus portion 22 pivoting about the hinge 23 toward the central portion 21. The annulus portion is shown as disposed at an angle of about 30° to the longitudinal axis or along a line normal to the longitudinal axis, and in this way the external dimension or circumference dimension of the closure is increased substantially and at the same time the annulus portion is compressed between the orifice surface 25 and the central portion to provide a tight-fitting relationship. In the at-rest position the annulus portion has its longitudinal component primarily oriented along the longitudinal axis of the central portion while in the closed position the longitudinal component is primarily along a line normal thereto.

When an especially tight-fitting and/or a sealed relationship between the closure and orifice is required, the external diameter of the annulus portion in the expanded position is as great as the compressibility of the material will allow. Situations where the diameter of the annulus portion is a maximum for the tightest possible fit and also in that instance where a retaining portion is required as described hereinafter, the closures preferably are inserted into the orifice by turning the axis of the closure relative to the axis of the orifice.

The closure 20 shown preferably is a unitary or one-piece body made entirely of the same resiliently yieldable material such as a polyolefin and made by a molding process. This closure has additional resiliency for expansion and contraction due to the resiliency in the material, and the hinge 23 has a memory that returns the annulus portion to the at-rest inclined position shown in FIGS. 1 and 3 once external contraction or expansion forces are removed.

In installing the closure 20 above described, the closure is first engaged by a suitable tool such as vaccum cup 28. The closure is then inserted into the orifice with the annulus portion contracting primarily by pivoting about the hinge as shown in FIG. 4 until the annulus portion reaches the correct position. The annulus portion 24 is then pivoted about the hinge 23 to move to the expanded position, and due to the corner 40 this may be accomplished by reversing the direction of movement of cup 28. In the expanded position, the annulus portion has a greater length in the radial direction and becomes compressed between the surface 25 and central portion 21, and surface 33 is resiliently urged against surface 25 while inside surface 34 is in close proximity or abutting engagement with the peripheral surface of central portion 21. As an alternative to pulling on the central portion a force may be applied to the outer peripheral portion of the annulus portion or this in combination with a pull exterted on the tool to move the central portion in a direction out of the orifice.

In removing the closure 20, a sufficient pulling force is exerted on the cup 28. An alternative procedure would be to first push the tool to force the closure into the container, turn the closure at an angle, and then pull the closure through the orifice. In this case only a portion of the annulus portion need contract to come back through the orifice.

Figure 8:
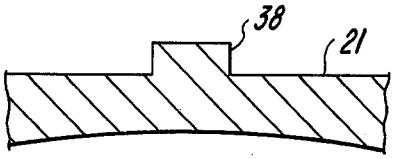
FIG. 8 is a fragment of the closure with a male gripping stud.
Figure 6:
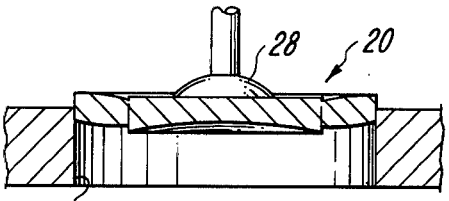
FIG. 6 is a cross-sectional view of the closure in the partially removed position.
Figure 9:
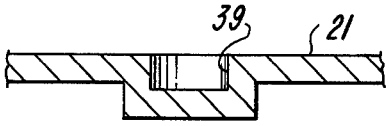
FIG. 9 is a fragment of the closure with a female receiving socket.

Alternative structures on the central portion are illustrated in FIGS. 8 and 9 to serve as means for gripping the closure. A male stud 38 projects up from the central portion on closure 21 in FIG. 8 and a recessed portion 39 is shown in FIG. 9 into which a push-pull tool is inserted.

Figure 10:
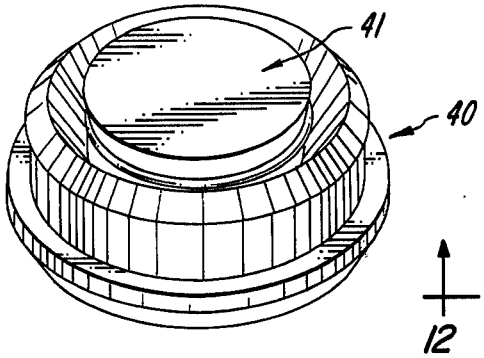
FIG. 10 is a top perspective view of a closure in the form of a bung embodying features of the present invention.
Figure 11:
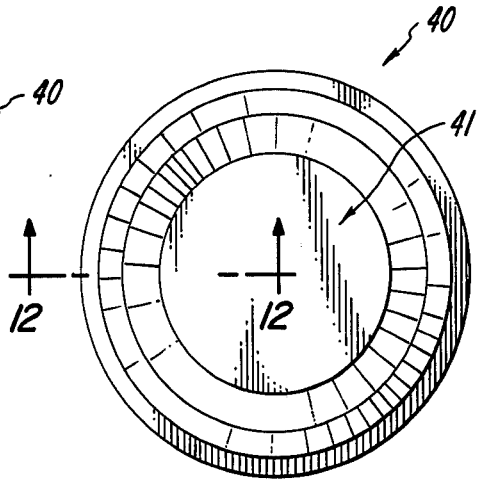
FIG. 11 is a top plan view of the closure shown in FIG. 10.
Figure 12:
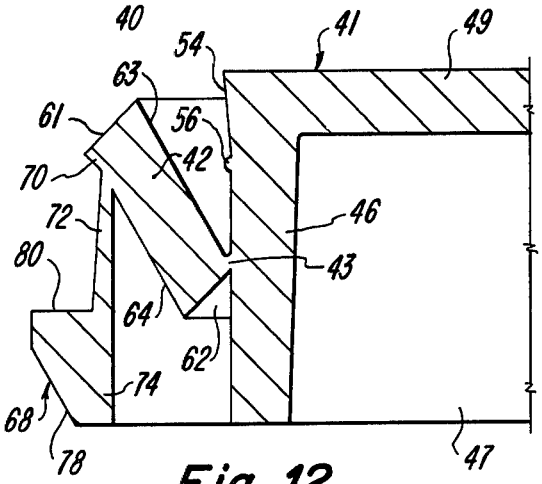
FIG. 12 is a cross-sectional view taken along section line 12—12 of FIG. 11 of the closure in the at-rest position.

Referring now to FIGS. 10–12, the closure 40 shown is specifically constructed for use as a bung for closing a fill orifice for a conventional beer barrel. Bung 40 has a central portion 41 and an annulus portion 42 connected at an inside edge by a hinge 43. The bung 40 shown is specifically adapted to close a circular orifice 44 defined by an outwardly diverging tapered wall surface 45, as is conventional with fill orifices in beer barrel construction. It is understood, however, that the bung 40 shown and described is also suitable for orifices of uniform diameter throughout the thickness of the wall.

The central portion 41 shown includes a generally hollow body with a cylindrical sidewall 46 open at the bottom into a central cylindrical cavity 47 and closed across the top by a top wall 49 and having a flat top surface suitable for printing various indicia thereon. The sidewall 46 is formed with a tapered annular shoulder 54, but this is a matter of manufacturing convenience only. A circumferentially continuous radiused bead 56 is formed on the sidewall to enhance gripping by a female tool that grips around the sidewall for installing and removing the closure 40, but this is optional as a variety of different types of gripping tools may be used. It is further noted that bead 56 need not be continuous but could be provided in circumferentially discontinuous segments. Bead 56 is optional.

The annulus portion 42 has a generally frusto-conical shape and is tubular or sleeve-like with a generally rectangular cross-sectional configuration. The annulus portion is wider at the top end and narrower at the bottom so as to incline away from the bottom. As best seen in FIG. 12 the rectangular cross-sectional configuration has an inclined, flat peripheral surface 61 that is also circumferentially continuous and symmetrically arranged about the longitudinal axis, together with an inside surface 62 opposite and spaced from the peripheral surface 61, a cone-shaped top surface 63, and a cone-shaped bottom surface 64 opposite and spaced from the top surface 63.

The hinge 43 is formed at the corner of surfaces 62 and 63 at the inside edge of the annulus portion and is in the nature of a narrowed, annular, circumferentially continuous segment. The bottom surface 64 and peripheral surface 61 meet at a corner 70.

Briefly, as with the previously described closure, the annulus portion 42 is arranged and supported to move in a toggle joint-like action once the corner 70 engages the surface defining the orifice and is pulled back through the orifice. Once a reverse axial force is applied to the central portion 41 and the periphery of the annulus portion 42 engages the orifice surface, the annulus portion swings or pivots about the pivot point established by hinge section 43 to an expanded position and inside surface 62 comes into contact with the peripheral surface of sidewall 46 to prevent the annulus portion 42 from pivoting further. The annulus portion 42 is compressed between central portion 41 and wall surface 45 to urge the peripheral surface 61 under compression against surface 45. In the expanded position shown in FIG. 13, the annular portion is disposed at only a slight angle of approximately 2° to a radial line normal to the longitudinal axis of the bung.

There is further provided a retaining portion 68 connected to the annulus portion 42 adapted to engage the wall to hold the outer edge portion against axial movement toward the top of the orifice during the toggle action and further to prevent the bung from being prematurely removed from the orifice.

The retaining portion 68 includes an annular connecting section 72 connected at the top end near the outer edge of the annular portion just inside corner 70 along bottom surface 64 and an annular enlarged bottom section 74 formed with a redially extending shoulder surface 80. The annular enlarged bottom section 74 further has a chamber 78 to enable the bung to be more easily slid into the orifice.

Because the bottom section 74 is enlarged with respect to connecting section 72 and annulus portion 42, the shoulder surface 80 formed therein serves to engage inside container surface 48 circumjacent the fill orifice for holding the outer edge of the annulus portion against axial movement in the container orifice to assist in the toggle joint-like action and further to seal the contents of the barrel, and prevent the bung 40 from being blown out of the fill orifice 44 by pressure from within the barrel. At the same time, however, the shoulder surface 80 may be dimensioned and the bung material may be selected to allow the shoulder surface to flex and the bung to blow out of the orifice when the internal pressure within the bung exceeds a maximum level.

The annular connecting wall section 72 is observed as having a peripheral surface that extends radially out at a slight angle to the longitudinal axis of the bung. This angle, which is based on an increased diameter from the top to the bottom is on the order of four degrees.

It is noted that annulus portion 42 is connected to the annular connecting wall section 72 near the outer edge thereof along the bottom surface 64 so as to be opposite and a distance from the bottom, leaving the bottom end of retaining portion 68 free to flex inwardly toward the central portion during insertion. The annulus portion 42 is connected at its opposite inner edge to the sidewall by the circumferentially continuous narrowed hinge 43 defining a hinge or pivot point for annulus portion 42 at an intermediate location between the top and bottom of the sidewall 46. The annulus portion 42 extends inwardly toward the central portion 41 and back toward the top from its connection to the sidewall 46 at an angle to the longitudinal axis of the central portion. In the form of the invention shown the inclusive angle between the sidewall 46 and the annular portion 42 is about 30°. The combined shape of the annular portion 42 and connecting section 72 is observed as being generally V-shaped.

The bung 40 above described does not require a lead-in skirt and the height-to-diameter ratio is relatively small, as on the order of less than one-to-two. The ratio of the preferred form shown is 0.75 to 2.0. This provides a bung that is of less material, less weight and less bulky than comparable bungs for beer barrel installation.

Figure 14:
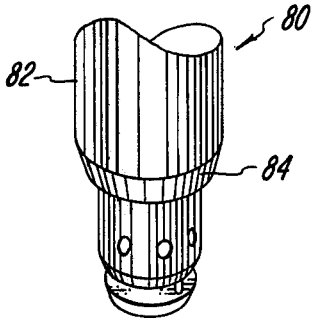
FIG. 14 is a perspective view illustrating one step of a method for installing the closure shown in FIG. 10 into a barrel.
Figure 14:
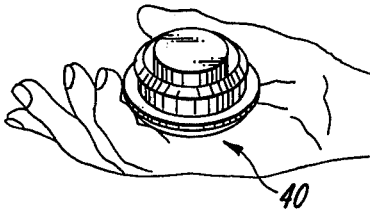

The bung 40 is preferably and advantageously installed in the fill orifice 44 of the beer barrel 48 by a method which utilizes conventional barrel filler apparatus modified with a support and gripping assembly of the present invention for supporting the bung 40 at the lower free end thereof. Conventional filler apparatus for filling a barrel is shown in FIG. 14 and generally designated by numeral 80. The filler apparatus 80 shown includes a hollow cylindrical rack arm 82 having a resilient seal member 84 mounted to its lower end. The rack arm 82 is movably mounted such that a filler operator may position a barrel 48 beneath the rack arm 82 and lower the rack arm 82 onto the barrel with the seal member 84 in sealing engagement with the wall of barrel 48 circumjacent to the fill orifice 44.

A hollow cylindrical filler tube 86 is axially movably mounted within the rack arm 82. The filler tube 86 has a plurality of circumferentially spaced fill holes 88 at one end and is coupled through suitable piping to pressurized gas and beer headers. Upon engagement of the rack arm 82 with the barrel 48, the filler tube 86 is lowered into the barrel and beer and pressurized gases directed through the fill holes 88 for filling the barrel.

A gripping head 90 and a slide rod 94 pivotally connected at its lower end to the head 90 at a pivot 95 are provided. Rod 94 is slidable in a guide cylinder 96 mounted on the lower end of the filler tube at an offset position so that, as the filler tube is moved down, the rod 94 slides in cylinder 96 and the head 90 engages stop 98 and tilts to an angle, as shown, and further downward movement forces the bung 10 through the orifice at that angle.

Figure 13:
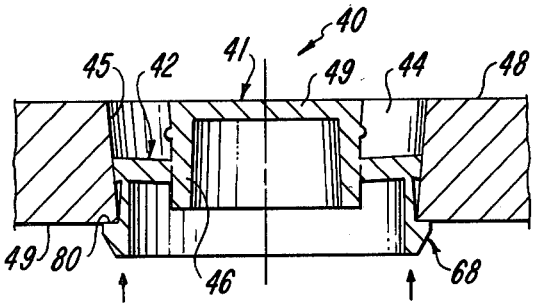
FIG. 13 is a cross-sectional view of the closure shown in FIG. 10 shown fully installed in an orifice of a beer barrel.
Figure 15:
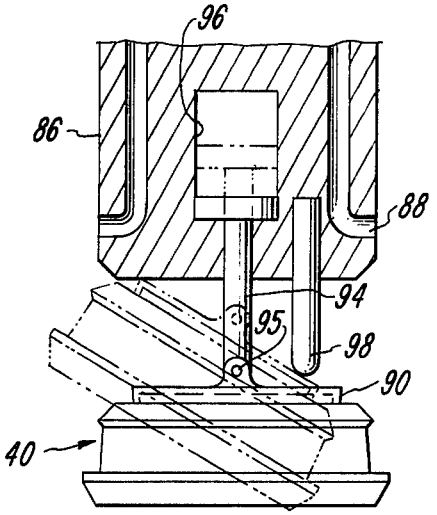
FIG. 15 is a side elevational view of filler apparatus for use with the closure shown in FIG. 10.

Once inside, on the upstroke of the filler tube the bung remains alined with the hole and pulling forces applied to the central body portion 41 and/or the pressure inside the barrel swing or pivot the annulus portion 42 to the expanded position shown in FIG. 13 wherein it is firmly wedged or compressed between the container wall surface 45 and sidewall 46.

Figure 17:
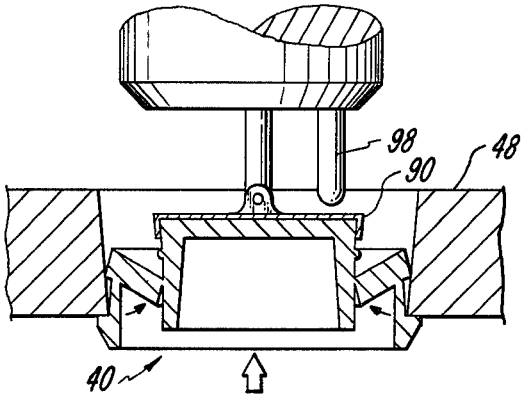
FIG. 17 is a cross-sectional view of the bung in the orifice just prior to its final installed position.
Figure 16:
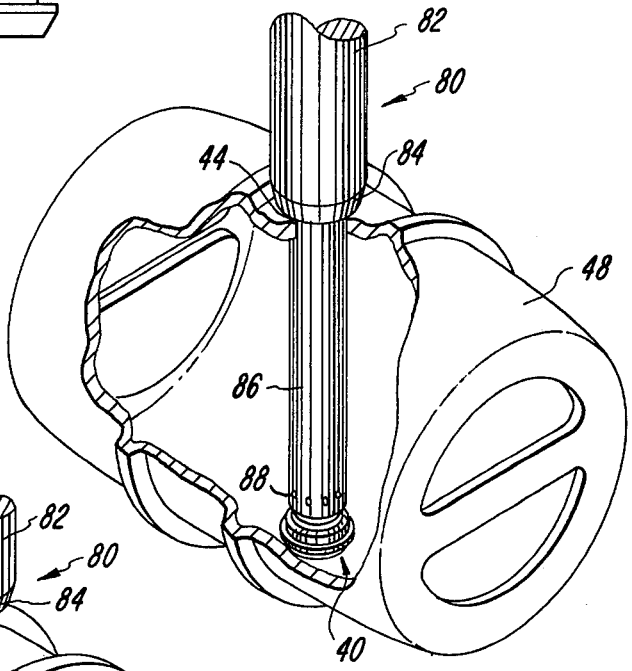
FIG. 16 is a perspective view, partially cut away, illustrating another step of a method for installing and removing the bung shown in FIG. 10.
Figure 18:
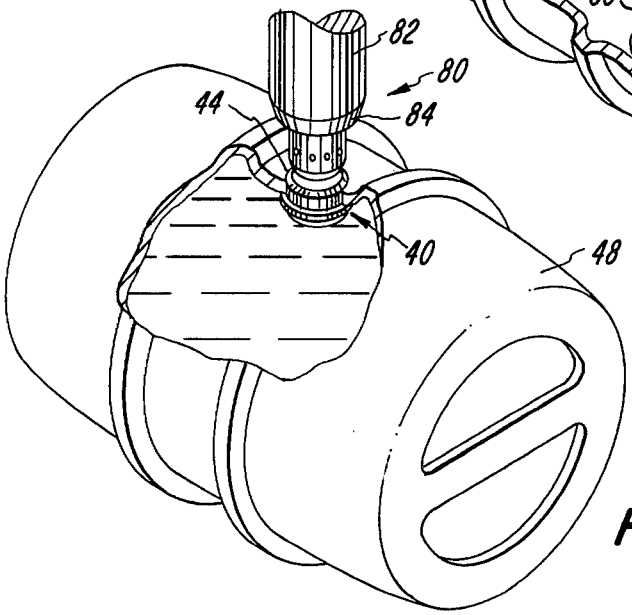
FIG. 18 is a perspective view, partially cut away, illustrating the final position for the bung.
Figure 19:
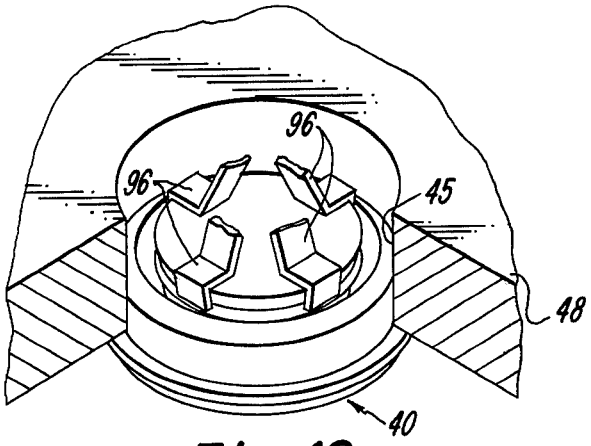
FIG. 19 is a perspective view illustrating the gripping of the bung for removing the bung shown in FIG. 10.

The gripping head 90 is generally cylindrical in shape and has a hollowed-out interior portion (FIG. 17) with sidewalls shaped to mate with the tapered shoulder 54 of the bung 40. Since the bung 40 is made of a resiliently flexible material, the bung may be inserted by hand into the fitting 90 in a pop-on action and retained within the fitting 90 by the tapered should 34. If a sufficient force is applied to bung 40, however, the tapered shoulder 54 may be popped out of the fitting 90 to release the bung.

The fitting 90 is connected by a slide rod 94 to the filler tube 86. With the linkage connection the fitting and bung may be rotated and positioned at an angle to the axis of the rack arm 82 for inserting the bung 40 through the fill orifice 44 of the barrel at an angle.

The filler apparatus 80 and fitting 90 are adapted to fill the barrel and install the bung 40 in the fill orifice 44 by a method which includes the steps of pushing the fill tube 86 and bung 40 through the orifice with the bung 40 situated at an angle to the axis of the orifice, filling the barrel with pressurized beer and gas, realining the bung so that its longitudinal axis is approximately coincident with the longitudinal axis of the orifice 44, and pulling the bung into sealing engagement with the orifice 44.

When the barrel has been filled the filler tube 86 can then be retracted, pulling the bung 40 into sealing engagement with the fill orifice 44. The filler tube 86 will continue to retract until the bung 40 pops out of fitting 90. With an effective seal established, the rack arm 82 can be removed from the barrel.

During insertion of the bung 40 into the fill orifice 44, at least a part of a circumference of the annulus portion 42 of the bung is distorted radially inwardly to offer the least amount of resistance for passing through the orifice 44. When the bung is pulled back an axial force is applied to the central portion and this force, along with the pressure generated by the contents of the barrel, causes corner 70 to become wedged against surface 45 first and then surface 80 against surface 49 so that annulus portion 14 pivots to an expanded position, shown in FIG. 13, in a toggle joint-like action and sealing surface 61 contacts the wall surface defining orifice 44 to seal the orifice. In this position annulus portion 42 is compressed between the wall surface 45 and central portion 46 to form a tight seal. The upward pressure forces on the bung tend to force the peripheral surface 61 of the bung 40 into sealing engagement with the orifice surface 45 and surface 80 into engagement with surface 49 of the barrel circumjacent to the fill orifice 44. This assists in preventing the bung from being blown out of the barrel by the pressure of the barrel contents.

Figure 20:
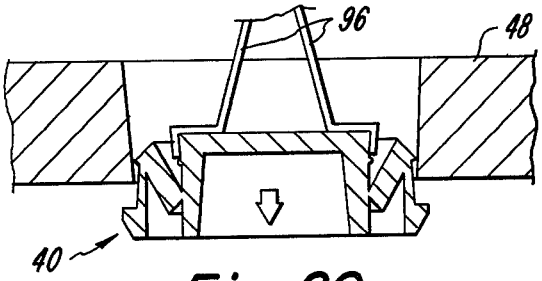
FIG. 20 is a cross-sectional view of the bung in the orifice with the removal tool in place and moved into the container.
Figure 21:
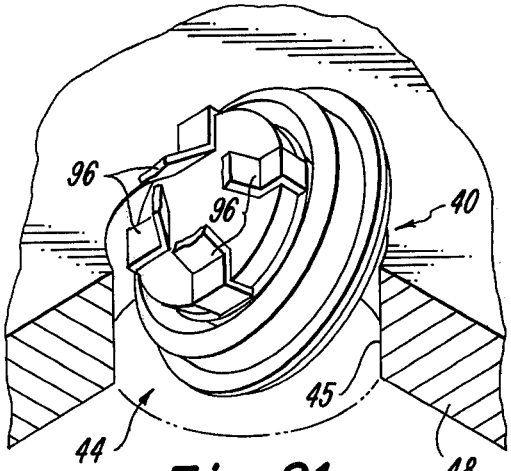
FIG. 21 is a perspective view illustrating another step of a method for removing the bung shown in FIG. 10.

A preferred method for removing the bung 40 from the fill orifice is carried on as shown in FIGS. 20, 21 and 22. For removing the bung 40 a gripping tool is used. The gripping tool shown has a plurality of circumferentially spaced gripping fingers 96 with lower end portions conforming to the shape of the central portion 42 to grip same. In practice the gripping fingers are normally biased to an opened, non-gripping position and are moved to a gripping position as shown.

It is understood that a variety of conventional gripping tools and techniques may be used. Thus, in a full removal sequence the bung 40 is gripped, is pushed down through the fill orifice 44, rotated as shown in FIG. 21 at an angle to the orifice, and then pulled out of the orifice.

The movement or action of the annulus portion 42, therefore, is similar to that of a toggle joint in that, when the central portion 21 is moved back toward the top, the annulus portion 42 expands and transmits pressure at right angles to the longitudinal axis of the central portion. Once the bung 40 is inserted through the orifice and the shoulder 80 is back of the container surface 49 and corner 70 engages the wall surface, then as the central portion 41 is pulled and/or as the container pressure is applied to the inside of the bung, the annulus portion 42 swings or pivots out to the expanded position with surface 61 being compressed against orifice surface 45 and inside surface 42 is urged against the peripheral surface of sidewall 46. Conversely, as an axially directed push-pull force is applied to the central portion 41, the annulus portion 42 moves about the hinge section 43 to a contracted position and the bung may easily be forced through the orifice into the inside of the container.

As is apparent from the above description, the bung 40 above described is constructed to be installed using conventional filler apparatus without the necessity of an impact tool. In addition, with this method of installation the barrel remains sealed by the rack arm of the filler apparatus until the bung is installed. There is thus little chance of pressure loss from the barrel prior to installation of the bung.

The bung itself is constructed to flex inwardly and pass easily through the orifice during installation, yet has a peripheral surface that flexes outwardly away from the central portion under the pressure within the barrel for providing a tight seal. Moreover, the construction of the bung allows the bung to be removed from the barrel in one piece with little chance of damage to the barrel.

Although the present invention has been described with a certain degree of particularity, it is understood that the present disclosure has been made by way of example and that changes in details of structure may be made without departing from the spirit thereof.

What is claimed is:

1. A closure for a surface defining an orifice comprising:

a central portion; and an annulus portion arranged about said central portion connected at an inside edge by a hinge to said central portion, said annulus portion being pivoted about said hinge to move to an expanded position with a peripheral surface movable with said annulus portion in engagement with a surface defining an orifice and said annulus portion compressed between said central portion and said orifice surface, said annulus portion being disposed at an angle diverging back away from the top of said central portion at an angle to a radial line normal to the longitudinal axis of said central portion and pivoting toward said radial line to said expanded position.

2. A closure as set forth in claim 1 wherein said annulus portion has a generally frusto-conical shape that is arranged concentrically about said central portion.

3. A closure as set forth in claim 2 wherein said annulus portion has a generally rectangular cross section.

4. A closure as set forth in claim 3 wherein said annulus portion has an inside surface opposite and spaced from said peripheral surface, a generally conical top surface, and a generally conical bottom surface.

5. A closure as set forth in claim 4 wherein said inside surface moves into engagement with an exterior surface of said central portion to limit the pivotal movement of said annulus portion in one direction.

6. A closure as set forth in claim 1 wherein said portions are of a one-piece molded plastic construction made entirely of the same material.

7. A closure for a surface defining an orifice comprising:

a central portion;

an annulus portion arranged about said central portion connected at an inside edge by a hinge to said central portion, said annulus portion being pivoted about said hinge to move to an expanded position with a peripheral surface movable with said annulus portion in engagement with a surface defining an orifice and said annulus portion compressed between said central portion and said orifice surface; and a retaining portion connected to said annulus portion adapted to engage said container wall for holding an outer edge portion of said annulus portion during movement of said central portion in a direction out of said orifice.

8. A closure as set forth in claim 7, wherein said central portion is a generally hollow body with a sidewall spaced from and extending substantially parallel to a longitudinal axis of said body, said peripheral surface being inclined at an angle to the peripheral surface of said sidewall and to a wall surface defining the container orifice, said peripheral surface moving to a position substantially parallel to said sidewall in said expanded position.

9. A closure as set forth in claim 7 having a height-to-diameter ratio of less than one-to-two.

10. A closure for a container having a wall with an orifice comprising:

a central portion;

an annulus portion arranged about and connected to said central portion by a hinge, said annulus portion being pivoted about said hinge to contract during insertion into a surface defining an orifice and to extend to an expanded position with a peripheral surface movable with said annulus portion in engagement with said orifice surface and said annulus portion compressed between said central portion and said orifice surface; and a retaining portion connected to said annulus portion adapted to engage a wall of said orifice for holding an outer edge portion of said annulus portion in relation to movement of said central portion out of said orifice.

11. A closure as set forth in claim 10 wherein said central portion includes an annular shoulder at its top end for gripping said closure with installation and removal tools.

12. A closure as set forth in claim 11 wherein said annular shoulder tapers from a point on said sidewall of said central portion away from the longitudinal axis of said central portion.

13. A closure as set forth in claim 10 wherein said retaining portion includes an annular connecting section connected at one end to an outer bottom edge of said annulus portion and at the opposite end to an enlarged body portion having a circumferentially continuous annular shoulder for contacting an inside wall circumjacent to said orifice.

14. A closure as set forth in claim 13 wherein said enlarged body portion has a chamfered surface.

15. A bung for sealing the pressurized contents of a container having a wall with a surface defining an orifice, comprising a one-piece body including:

a resilient, generally cylindrically shaped central portion having a generally cylindrical sidewall and a top wall;

a resilient annulus portion arranged about said central portion and connected by a resilient hinge section to said sidewall, said hinge section being a narrowed annular segment formed at a radially inner end of said annulus portion and connected to said sidewall defining a hinge point at an intermediate location between the top and bottom of said sidewall to distort during insertion into a container wall with a surface defining an orifice and to extend outwardly to an expanded position in response to axial movement of said central portion in a toggle jointlike action, said annulus portion having a peripheral sealing surface for engaging a container wall surface defining said orifice whereby said annulus portion is compressed between said central portion and said container will surface to close the orifice when in position in the orifice; and a circumferentially continuous annular shoulder connected to said annulus portion for contacting an inner wall surface of said container circumjacent to said orifice for holding an outer edge of said annulus portion against movement in said orifice relative to movement of said central portion out of said orifice.

16. A bung as set forth in claim 14 wherein said annular shoulder is connected to said annulus portion by an annular connecting section between the outer edge of said annulus portion and said annular shoulder, the connection of said annulus portion to said central portion being axially offset along said central portion toward the bottom in relation to the connection of said annulus portion to said connecting section.

17. A bung for sealing an orifice of a pressurized container, comprising a one-piece molded plastic body including:

a generally cylindrically shaped central portion symmetrically arranged about a longitudinal axis and having a generally cylindrical sidewall, a flat, generally circular top wall, and an enlarged diameter tapered shoulder formed circumjacent to said end wall; and an annulus portion symmetrically arranged about said longitudinal axis and connected to said sidewall by a circumferentially continuous resilient hinge section, said annulus portion having a generally frustoconical shape and a generally rectangular cross section and extending from said sidewall radially outwardly toward the top end and provided with a peripheral surface, and an enlarged diameter annular shoulder connected at the outer radial end of said annulus portion and extending radially out therefrom, whereby an installation tool is releasably attached to said tapered shoulder for pushing said bung through the orifice at an angle to the axis of the orifice with said arm portion flexed radially inwardly to pass through the orifice, and whereby the bung is positioned with its longitudinal axis substantially coincident with said orifice axis and pulled into said orifice, with said peripheral surface compressed against the orifice wall and said enlarged annular shoulder abutting an inside wall of said container circumjacent to the orifice, and said annulus portion is flexed outwardly by the container pressure into contact with the surface defining the orifice.

18. A method of removing a closure having a central portion and a flexible annular portion with a peripheral surface that is symmetrically arranged about the longitudinal axis of the central portion from an orifice of a container, said closure having a larger external dimension than the internal dimension of said orifice, said method comprising:

pushing the closure through the orifice into the inside of the container;

positioning the longitudinal axis of the closure at an angle to said orifice; and pulling the closure through the orifice by moving said peripheral surface into engagement with the surface defining the orifice to compress said annular portion between said central portion and said surface defining said orifice.

19. A method as set forth in claim 18 including the gripping of the closure prior to pushing the closure into the inside of the container.

* * * * *